US006629648B1

(12) United States Patent
Jones

(10) Patent No.: US 6,629,648 B1
(45) Date of Patent: Oct. 7, 2003

(54) HEIGHT ADJUSTABLE RISER FOR A SPRINKLER

(76) Inventor: Steven Jones, 1101 Via Hispano, Newbury Park, CA (US) 91320

( * ) Notice: Subject to any disclaimer, the term of this patent is extended or adjusted under 35 U.S.C. 154(b) by 0 days.

(21) Appl. No.: 10/366,653

(22) Filed: Feb. 14, 2003

Related U.S. Application Data

(60) Provisional application No. 60/420,357, filed on Oct. 23, 2002.

(51) Int. Cl.[7] ..... B05B 15/10

(52) U.S. Cl. ..... 239/203; 239/200; 239/201; 239/202; 239/204; 239/205; 239/206

(58) Field of Search ..... 239/200, 201, 239/202, 203, 204, 205, 206, 539

(56) References Cited

U.S. PATENT DOCUMENTS

| | | | | | |
|---|---|---|---|---|---|
| 1,833,040 | A | * | 11/1931 | Rader | 285/302 |
| 3,317,144 | A | * | 5/1967 | Muschett | 239/204 |
| 3,684,179 | A | * | 8/1972 | Fischer et al. | 239/203 |
| 4,099,670 | A | * | 7/1978 | Cole et al. | 239/205 |
| 4,220,283 | A | * | 9/1980 | Citron | 239/205 |
| 4,274,592 | A | * | 6/1981 | Westhusin | 239/200 |
| 5,133,501 | A | * | 7/1992 | Marshall | 239/201 |
| 6,050,500 | A | * | 4/2000 | Ensworth | 239/203 |
| 6,530,531 | B2 | * | 3/2003 | Butler | 239/205 |

* cited by examiner

*Primary Examiner*—Robin O. Evans
(74) *Attorney, Agent, or Firm*—Roger A. Marrs

(57) ABSTRACT

An adjustable riser for adjusting the elevational position of an irrigation sprinkler with respect to the surrounding ground level and/or with respect to the height of surrounding vegetation to be irrigated. The riser includes a movable cartridge within an internal bore of a housing having a plurality of catches outwardly projecting from the exterior wall of the cartridge and adapted to resiliently snap into or out of notches carried on the inner wall surface of the bore movably supporting the cartridge. The sprinkler is carried on a tube for discharging water while the opposite end of the tube includes an impact plate against which water pressure from the supply impinges. Upon impact, the tube with the sprinkler is forced upward within a housing against expansion of a spring, which normally urges the tube and sprinkler into a storage position within the housing. A linear adjustment of the riser, including the sprinkler and its tube, is effective by incorporating the cartridge with the catches movable within a toothed groove formed in the inner wall of the riser housing. The groove includes spaced-apart spiral teeth which are selectively engageable by the catches of the cartridge. Each of the catches are resiliently mounted in the cartridge and are yieldably urged into the notches or grooves for selective engagement with the teeth thereof.

12 Claims, 5 Drawing Sheets

HEIGHT ADJUSTABLE RISER FOR A SPRINKLER

This Priority claimed Based on Provisional application Serial No. 60/420,357 filed Oct. 23, 2002.

BACKGROUND OF THE INVENTION

1. Field of the Invention

The present invention relates to the field of irrigation sprinkler systems and more particularly to an adjustable riser for coupling an irrigation sprinkler to a water supply line, wherein the riser allows for elevational positioning of the sprinkler to be adjusted quickly and easily to a desired height relative to the surrounding ground level.

2. Brief Description of the Prior Art

In the past, conventional irrigation sprinkler systems have been employed wherein a plurality of individual irrigation sprinkler heads or units are connected with a water supply line in order to provide irrigation water to a selected terrain area. The supply line is often buried underground and is coupled by various joints and extending risers to the individual sprinkler unit or head. The length of the risers are individually chosen to achieve partial or full exposure of the individual sprinkler unit at a selected height relative to the ground level in accordance with the buried depth of the supply line as well as the type and height of the specific surrounding vegetation, such as a grass lawn or the like. When the irrigation system is initially installed, it is normally required to provide risers of several different lengths or alternately to cut individual risers to custom length.

The ground level and height of vegetation changes over time so that the water discharge from the sprinkler system is blocked or is substantially interfered with so that inefficient irrigation results. For example, soil and organic matter can build up or erode from the vicinity of individual sprinkler units, resulting in a need to adjust the elevational position of one or more sprinkler units. Moreover, vegetation, such as shrubs, grass, or the like grows significantly, or taller vegetation can be trimmed to a shorter height or otherwise replaced with shorter plants to result in a need to adjust the elevational position of one or more sprinkler units. In a typical irrigation system, such positional adjustment has required removal and replacement of risers, with at least some attendant digging to expose the varied water supply line, in order to access and replace risers as well as other components.

Therefore, a long-standing need has existed to provide a means for adjusting the height of a sprinkler unit with respect to ground level or with respect to height of vegetation and such adjustment means should not entail removal of earth or merely replacement of irrigation sprinkler units. Means for adjusting the height of risers and sprinkler heads should be inherent in the structure of the riser, so that manual grasping of the riser and rotational or linear movement performs the adjustment procedure.

Accordingly, the present invention pertains to an improved adjustable riser for coupling an irrigation sprinkler head or unit to a water supply line, wherein the elevational position of the sprinkler can be vertically raised or lowered quickly and easily without requiring replacement of component parts, unburying the sprinkler head or riser itself, and wherein the adjustment means forms an integral component of the sprinkler riser so that a unitary construction is obtained.

SUMMARY OF THE INVENTION

Accordingly, the above problems and difficulties are avoided by the present invention which provides an adjustable riser for quickly and easily adjusting the. elevational position of an irrigation sprinkler with respect to the surrounding ground level and/or with respect to the height of surrounding vegetation to be irrigated. In one form of the invention, the riser unit includes a movable cartridge within an internal bore of a housing having a plurality of catches. outwardly projecting from the exterior wall of the cartridge and adapted to resiliently snap into or out of grooves or notches carried on the inner wall surface of the bore movably supporting the cartridge. The sprinkler head or nozzle is carried on a tube for discharging water while the opposite end of the tube includes an impact plate against which water pressure from the supply impacts. Upon impact, the tube with the sprinkler head is forced upward within a housing against expansion of a coil spring, which normally urges the tube and sprinkler head into a storage position within the housing.

In another form of the invention, linear adjustment of the riser unit, including the sprinkler head and its tube, is effective by incorporating the cartridge with the catches movable within a toothed groove formed in the inner wall of the riser housing. The groove includes spaced-apart spiral teeth which are selectively engageable by the catches of the cartridge. Each of the catches are resiliently provided in the cartridge and are yieldably urged into the notches or grooves for selective engagement with the teeth thereof.

Also, envisioned is the use of compressible or expandable tubing as well as the feature of incorporating separate lengths of riser and sprinkler housing components for achieving the desired sprinkler nozzle height.

Therefore, it is among the primary objects of the present invention to provide a novel irrigation system having sprinkler heads or nozzles which are carried on an adjustable means for elevational positioning of the sprinkler nozzle above the ground or vegetation level.

Another object of the present invention is to provide a novel adjustable means for sprinkler heads which includes a rotary adjustment whereby the spring-loaded catches engage with internal teeth on the inner wall of the riser housing whereby not only can the height of the sprinkler nozzle be adjusted above ground or vegetational level but the selected elevation is releasably maintained until it is desired to readjust.

Still another object resides in providing a manually adjustable height mechanism for a sprinkler nozzle whereby the riser unit for the sprinkler head includes releasable catch means for holding the sprinkler head at a desired height after vertical adjustment.

Still a further object resides in an irrigation system employing a plurality of sprinkler units which are connected to a main water supply by means of flexible conduits or piping that may be readily compressed to shorten or expanded to lengthen the piping.

Yet another object resides in providing an automatic adjustment system for manually adjusting the height of a sprinkler head above the level of ground or vegetation which includes the use of selected lengths of riser and sprinkler components so that when combined together provide a desired height for the sprinkler nozzle or head.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
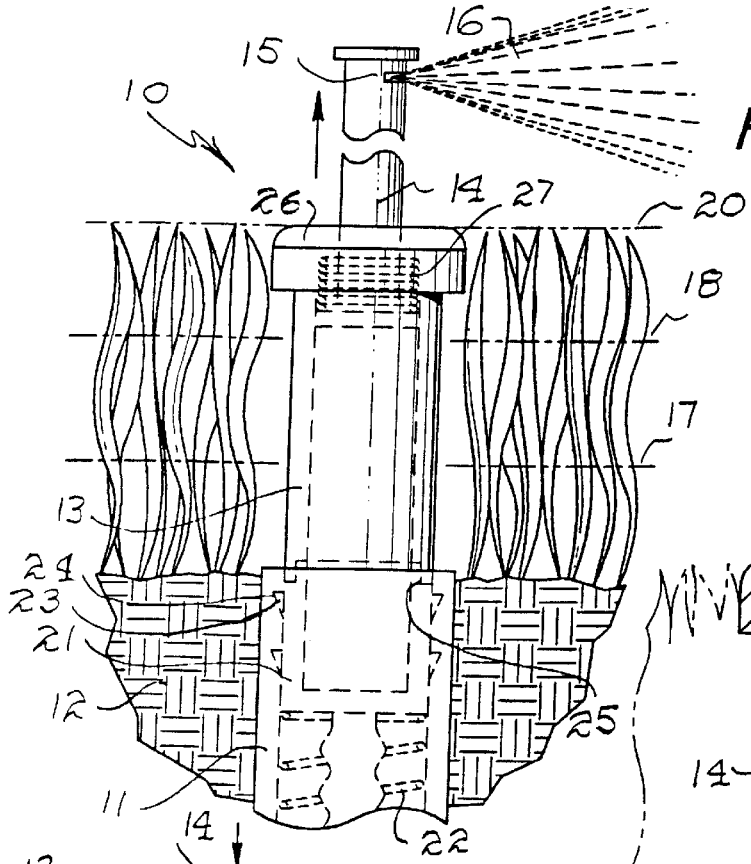
FIG. 1 is a side elevational view of an adjustable height sprinkler head employing the present invention.

Referring to FIG. 1, the novel height adjustable riser for a sprinkler is indicated in the general direction of arrow 10 wherein the device includes a cylindrical housing 11, buried in earth 12, and which includes a riser unit 13 which houses a linear moving tube or element 14 terminating at its exposed end in a movable sprinkler nozzle for discharging water therefrom. The nozzle is indicated by numeral 15 while the water discharge or spray is indicated by numeral 16. Broken lines 17, 18 and 20 represent varying heights of vegetation growth which require vertical adjustment of the riser 13 so that the sprinkler nozzle 15 will distribute water above the height of the ground or the height of the vegetation. The height adjustment for the riser unit, incorporating the present invention, can be employed to raise the sprinkler nozzle in increments as illustrated by the broken lines 17, 18 and 20.

It can be seen that the riser unit 13 is fixed onto a cartridge 21 mounted in the base of housing 11 and is biased upwardly by means of an expansion spring 22. The cartridge and riser are prevented from removal from the housing 11 by means of a plurality of catches, such as catch 23, which is releasably engaged with a notch 24 formed in the cartridge wall and on the inside surface of the bore defined by the wall of housing 11. The end of the riser unit 13 is threadably coupled to the cartridge 21 by means of a threaded connection 25. The opposite end of the riser unit 13 includes a cap 26 which is threadably connected thereto by threads 27. The cap includes an opening through which the sprinkler tube 14 can move rectilinearly in the reciprocal directions .of the arrow.

Figure 2:
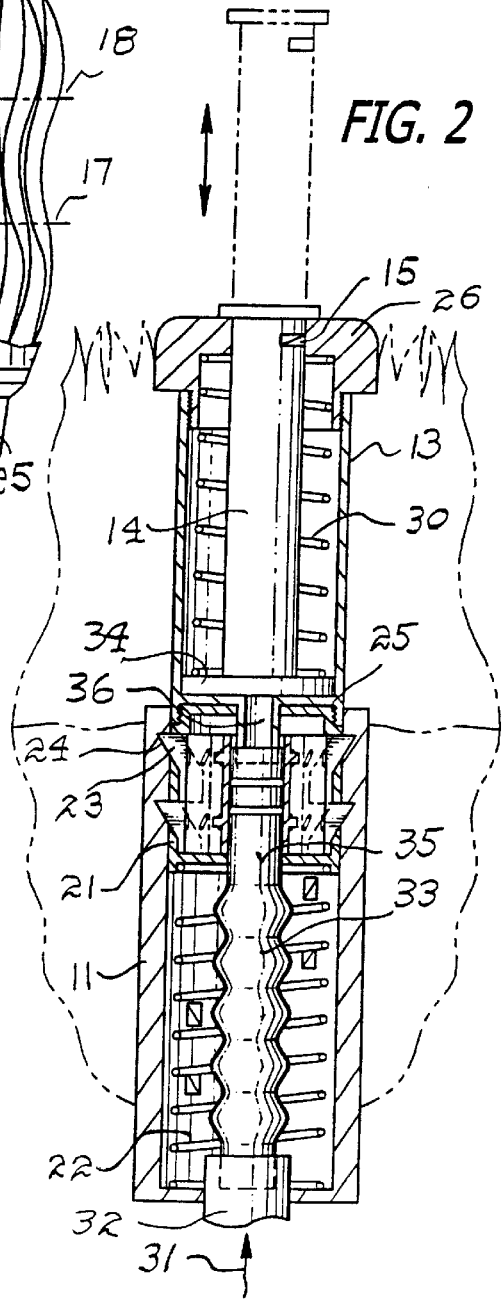
FIG. 2 is a view, similar to the view of FIG. 1, illustrating the sprinkler head raised or elevated from the position shown in FIG. 1.
Figure 3:
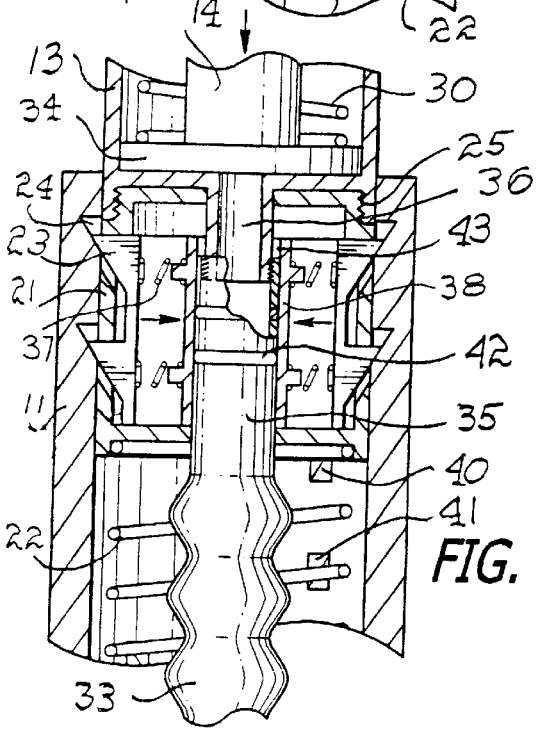
FIG. 3 is an enlarged, fragmentary view, partly in section, illustrating the cartridge mechanism employed in the embodiment shown in FIGS. 1 and 2 for elevating the sprinkler unit.

Referring now to FIGS. 2 and 3, it can be seen that the sprinkler tube or element 14 can be elevated against the expansion of a coil spring 30 when pressurized water is supplied from a water source in the direction of arrow 31. The sprinkler unit 10 is coupled to the water supply by a variable length hose or conduit 32, which introduces the pressurized water through a variable length hose 33 to impinge against an impact plate 34 carried on the lower end of the sprinkler tube 14. As part of the pressurized water supply, it is noted that the pressurized water passes through the cartridge 21 via a coupler piece 35 which includes communication with a conduit 36 terminating at the underside of the impact plate 34. Therefore, pressurized water introduced from the conduit 32 is forwarded through the expansion hose 33 and the passageway 36 to the underside of the impact plate so that the pressure forcibly urges the sprinkler nozzle upwardly to the position shown in broken lines. The upward positioning of the sprinkler nozzle 15 via tube 14 is against the expansion pressure of the spring 30. Therefore, when the pressurized water is reduced or shut-off, the compressed spring 30 will expand outwardly between the cap 26 and the impact plate 34 causing the sprinkler nozzle to retreat through the cap 26 to the storage position or non-operative position, as shown in solid lines.

Referring now in detail to FIG. 3, it can be seen that the cartridge 21 is threadably connected to the riser unit 13 by threads 25 so that a unitary construction is provided. Also, it is noted that the inside wall surface of the body 11 includes a plurality of notches, such as notch 24, into which catches, such as catch 23, is normally biased by means of an expansion spring 37. As illustrated, at least four catches are shown and are carried on a member 38 within an internal cavity of the cartridge 21. Outward movement of the catches in response. to expansion of the springs 37 is restricted when the member 38 engages the wall of the cartridge 21. Also, penetration of the catches within the notches 24 will also limit the expansion movement of the catches. Spring 22 bears against the underside of the cartridge 21 and forcibly urges the cartridge as well as the riser upwardly and the upward movement is limited only by engagement of the catches with the notches as previously described. Notches can be placed along the inside surface of the bore of housing 11 and additional notches at a lower level are not shown engaged by catches are indicated by numerals 40 and 41 respectively. It can also be seen that a pair of O-rings 42 are installed on the coupling 35 and bear against an open-ended bore carried at the center of the cartridge 21. The open-ended bore-is illustrated by numeral 43. Catch 23 includes an angular undersurface slidably engageable with a sloping ramp in the notch 24.

Figure 7:
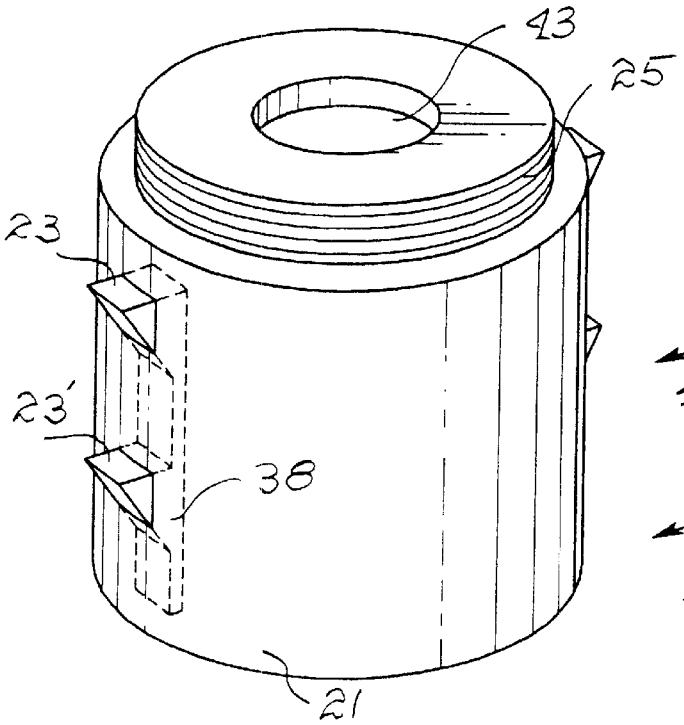
FIGS. 7 and 8 represent a perspective view of the catch mechanism used in the embodiment of FIGS. 1 and 2.
Figure 8:
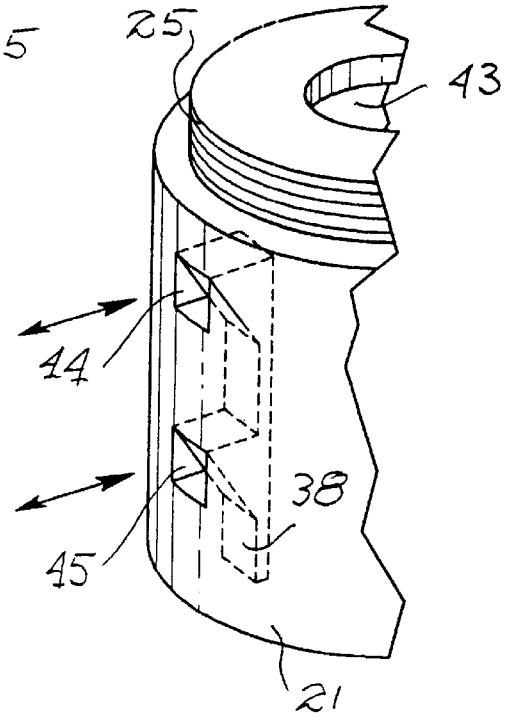

Referring now in detail to FIGS. 7 and 8, it can be seen that the cartridge 21 includes openings, such as opening 44 and 45, through which catches 23 and 23' move in a rectilinear manner. As illustrated, the catches are arranged in pairs and are carried as a unit on member 38. Other pairs of catches are located on the other side of the cartridge.

Therefore, in view of the foregoing, it can be seen that water supplied under pressure to the impact plate 34 will cause the sprinkler head or nozzle to rise to an extended position. When the supply is turned off or reduced, the expansion of compressed spring 30 will cause the sprinkler head to retract into the riser unit. When it is desired to raise or lower the riser unit, the user need only to push down slightly and twist or rotate the riser unit in order to disconnect the catches 23 from notches. The catches are urged against their expansion: spring and the cartridge can be moved upwardly or downwardly accordingly. When it is desired to set the sprinkler nozzle at a certain elevation, the user twists or turns the riser assembly until the catches match a desired level of notches.

Figure 4:
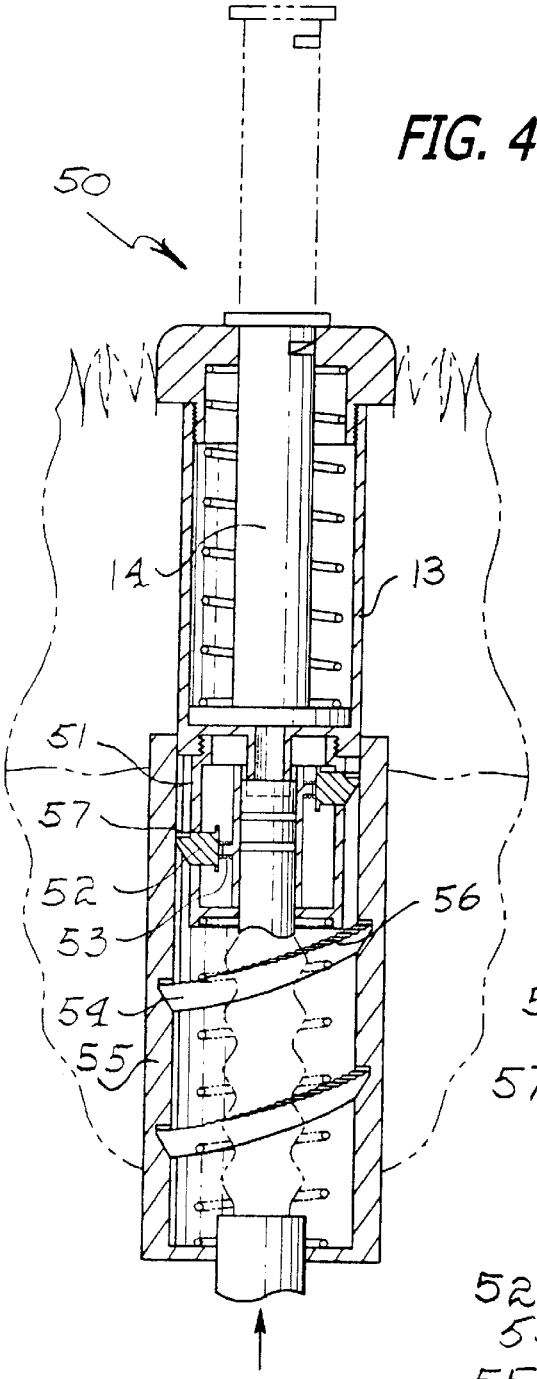
FIG. 4 is a longitudinal, cross-sectional view of another embodiment of the present invention illustrating a different adjustment mechanism-employing a spiral tooth groove and resilient catches carried on the sprinkler unit.
Figure 6:
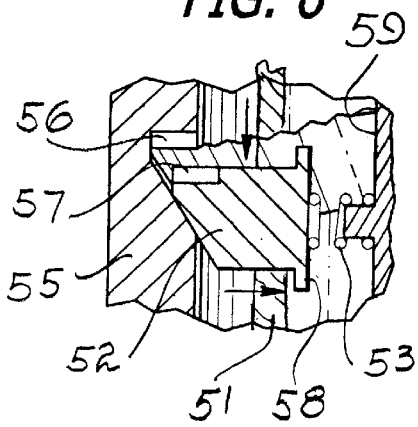
FIG. 6 is a greatly enlarged fragmentary sectional view illustrating the groove and catch mechanism employed in the adjustment means shown in the embodiment of FIGS. 4 and 5.
Figure 5:
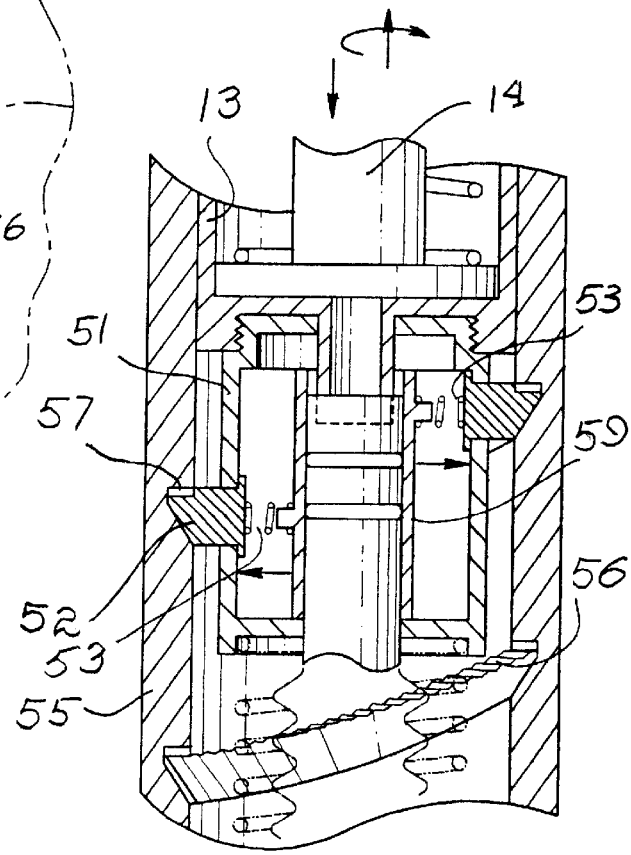
FIG. 5 is an enlarged fragmentary view, in section, of the adjustment mechanism used in the embodiment shown in FIG. 4.

Referring now in detail to FIGS. 4 and 5, another embodiment of the present invention is illustrated in the direction of arrow 50. The riser components and sprinkler tube and nozzle employ the same numerals as previously described with respect to the embodiment in FIG. 1 since the main difference between the embodiments resides in the cartridge which is identified in FIGS. 4 and 5 by numeral 51. In this embodiment, the cartridge includes a set of catches 52 which include a resilient expandable spring 53 that urges the catch into a spiral groove 54 formed on the inside of the bore and into the wall of housing 55. It is be particularly noted that the spiral groove includes a plurality of continuous teeth, such as indicated by numeral 56, that downwardly depend from the top of the groove. These teeth are selectively engageable by a tooth 57 carried on the respective catches so that when the catch is within the groove 54, the cartridge will remain in a fixed position when the teeth of the catches engage with the teeth of the groove. Such an arrangement is more clearly illustrated in FIG. 6, wherein it can be seen that the catch moves into or out of the groove horizontally when the spring 53 is either compressed or expanded. When expanded, the catch will enter the spiral groove 54 and the catch tooth 57 will engage with the downwardly depending teeth 56 in the groove. Each of the respective teeth have a flanged end 58 against which the spring 53 bears. The flange serves as a stop for limiting expansion of the catch through the wall of the cartridge which includes an opening for permitting the catch to move back and forth. Also, it can be seen in FIG. 6 that the underside of each catch 52 includes an angular surface which engages with a sloping ramp of the groove 54 so that as the catch moves outwardly, the catch will be directed upwardly whereby the teeth 56 and 57 will readily engage. This action is also true with respect to the catch 23 and the notch 24 in the embodiment shown in FIGS. 1–3 inclusive.

Therefore, in view of the foregoing, it can be seen that the sprinkler head carried by the riser can be raised in height with respect to the height of vegetation, ground level or the like, by rotating the riser unit so that the riser will turn with respect to the housing 55. As rotation continues, the catches 52 will ride through the groove 54 in a spiral manner so as to raise the cartridge 51 and riser unit upwardly or downwardly, as required. Therefore, adjustment is achieved by means of the catches in the cartridge which ride within the groove 54.

Figure 9:
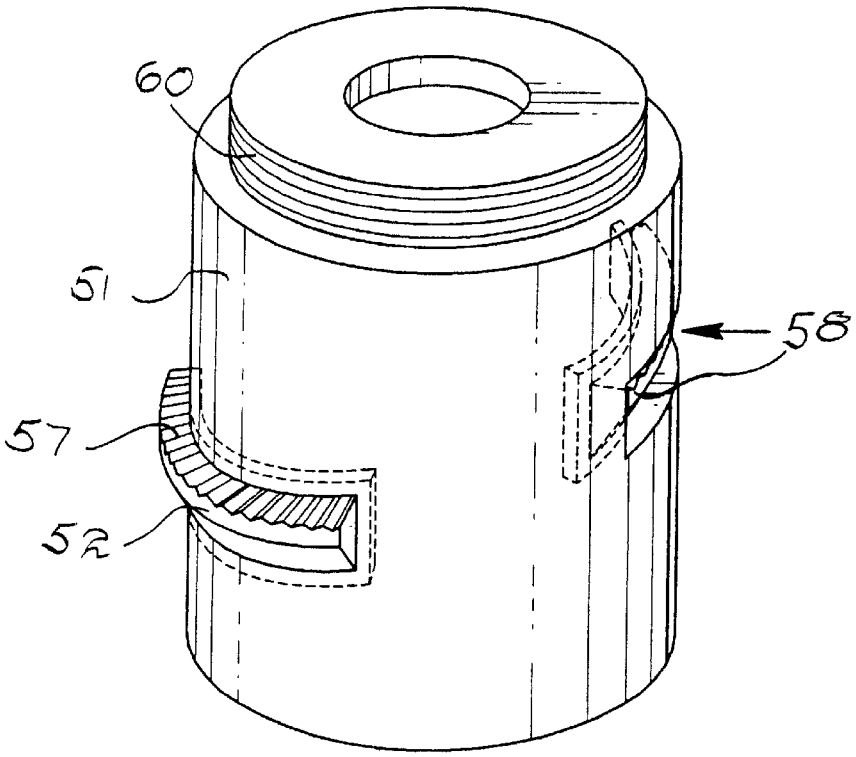
FIG. 9 is a perspective view of a cartridge carrying a resiliently mounted piece having a toothed element that projects into the special groove of the embodiment shown in FIGS. 5 and 6.

In FIG. 9, the cartridge 51 is illustrated and it can be seen that the catch 52 includes a plurality of teeth 57 and that the arrangement of teeth on the catch can move inwardly and outwardly of the cartridge housing. When it is desired that the cartridge and riser unit be moved, the teeth are compressed against the expansion of their springs so that the toothed recess, within groove 58 for example, forms in the wall of the cartridge 51. The cartridge 51 includes a threaded fitting 60 which threadably contacts with the bottom of the riser unit 13, as previously described.

Figure 10:
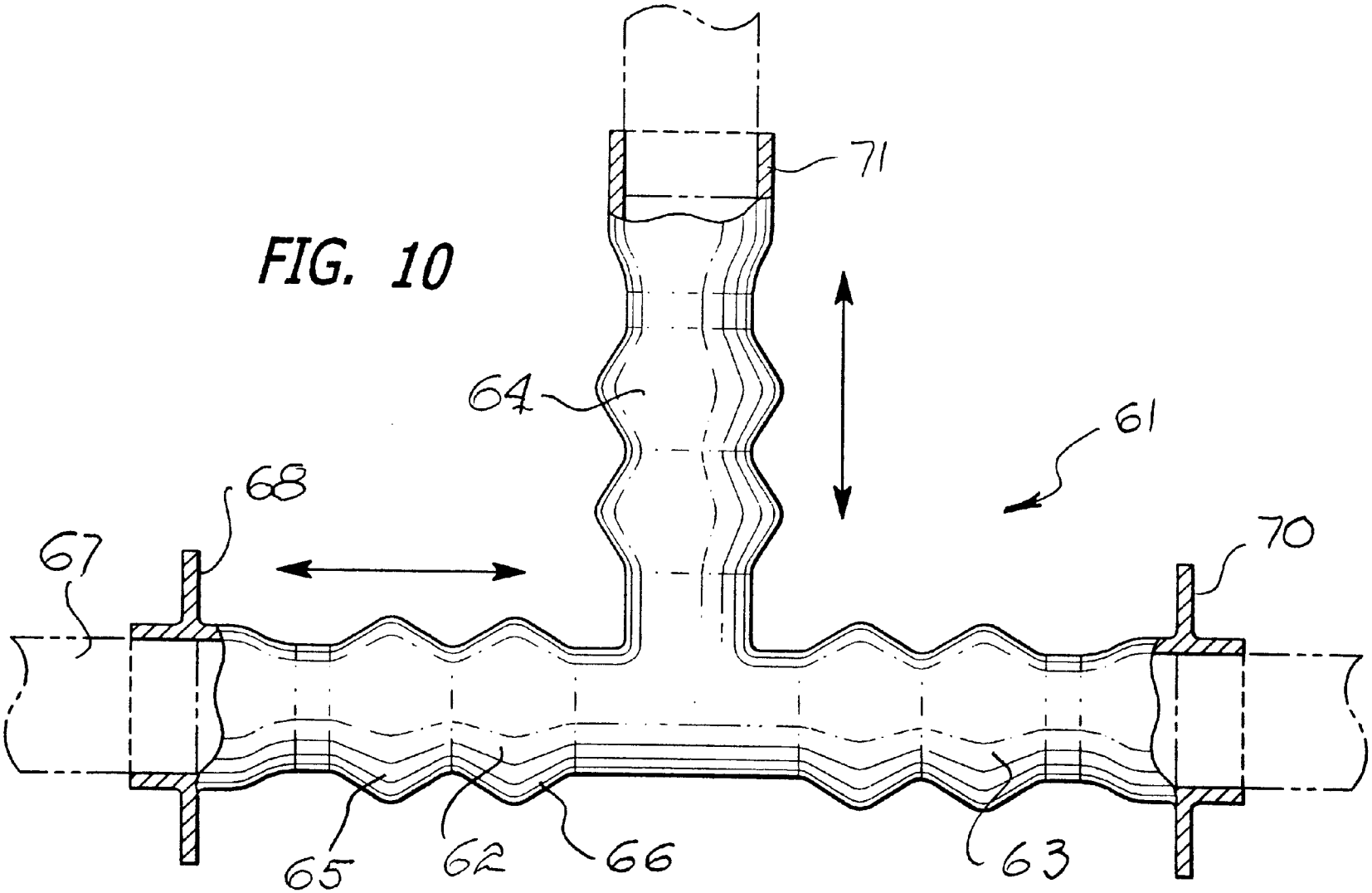
FIG. 10 is a side elevational view of an expandable pipe or conduit joining components of an irrigation system wherein segments of the pipe can be contracted to shorten or expanded to lengthen.

Referring now to FIG. 10, a novel tubular construction is illustrated in the general direction of arrow 61, which is used in connection with the height adjustable riser for sprinklers shown in FIGS. 1–9 inclusive. The novel conduit is expandable and contractible since it is provided with a plurality of convolutions and a relatively thin wall so that the sections of the tubing can be expanded or contracted. For example, a T-conduit is illustrated in the direction of arrow 61, which includes a first section 62, a second section 63 and a third section 64. Each of the respective sections includes a length of flexible tubing which is provided with a series of bulges or convolutions, such as convolutions 65 and 66, with respect to section 62. The open or free end of each section is connected to a fixed pipe or other conduit and such is indicated by numeral 67. The section 62 may be expanded by pulling on the flange 68 causing the section to expand. However, contraction can also be achieved by pushing the flanges 68 so as to reduce the length of the section 62. The same is true with respect to sections 63 and 64. A flange 70 is included for grasping by the fingers of the user in order to lengthen or shorten the section 63. Although no flange is shown for section 64, the user's fingers may readily grasp a collar portion 71 whereby the section 64 may be lengthened or shortened accordingly. It is to be understood that the contraction and expansion of the tubing section is linear.

Figure 11:
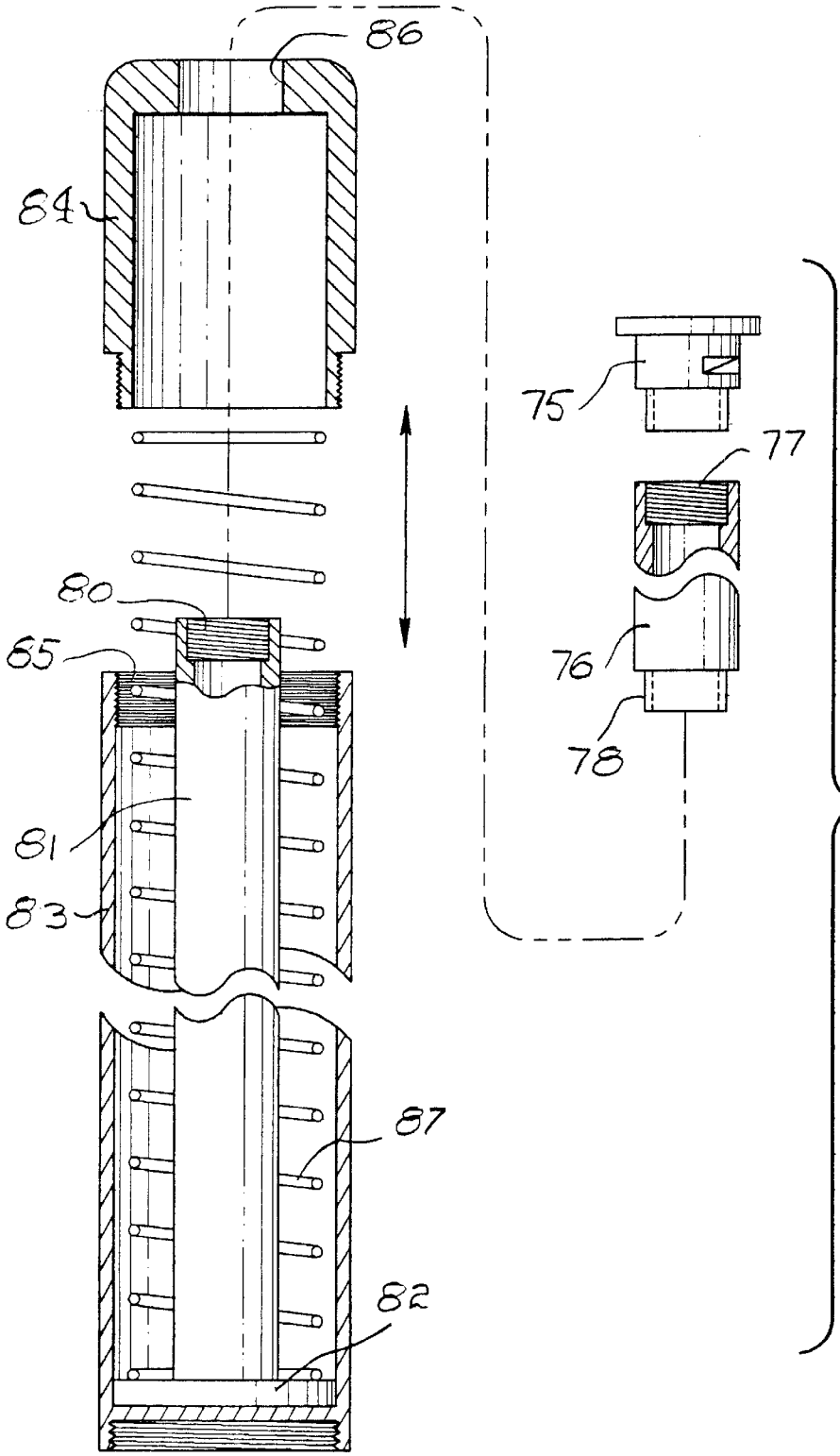
FIG. 11 is an exploded sectional view of another version of the present invention, whereby separate components of riser and sprinkler unit can be elevationally increased through the use of different length component parts.

With respect to FIG. 11, another embodiment of the invention is illustrated for adjusting the height of a sprinkler nozzle such as the nozzle indicated by numeral 75. The nozzle is attached to an extension piece 76 by means of a threaded connection 77. The extension 76 maybe as long or as short as needed by the user to elevate the sprinkler nozzle or head 75 above vegetation or the ground. The end of extension 76 opposite from the threaded end 77 includes a member 78 which is insertably received in threaded connection with threads 80 carried on the end of a sprinkler tube 81. The tube includes an impact plate 82 against which pressurized water impinges, as previously described, to forcibly urge the tube 81 out of a housing 83 so as to elevate the extension and sprinkler head 75 to its desired position. A cap 84 is threadably connected to the end of housing 83, as indicated by the threads 85, and the cap includes an opening 86 for permitting reciprocation of the sprinkler tube 81 when water pressure is applied to or withdrawn from the impact plate 82. Spring 87 yieldably urges the tube 81 to retract the nozzle 75 when the pressure of the water is reduced or withdrawn. It is to be understood that a plurality of lengths of extensions 76 may be included in a kit or in a package and that the user may select a desired length for his purposes.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A height adjustable riser for a sprinkler comprising:

a housing embedded in the ground;

a riser secured to said housing projecting about the ground;

a resiliently biased tube movably mounted in said riser having a nozzle at one end thereof and an impact plate at its other end;

said tube normally biased inside said riser to conceal said nozzle and adapted to expose said nozzle in response to water pressure against said impact plate; and means within said housing and secured to said riser for releasably holding said riser in a selected position on said housing for adjusting height of said nozzle above the ground.

2. The height adjustable riser for a sprinkler defined in claim 1 wherein:

said means for releasably holding said riser includes a cartridge within said housing and attached to said riser for movement together as a unit;

said housing having a plurality of openings arranged in fixed, spaced-apart relationship; and resistantly mounted catches carried on said cartridge selectively engageable with said openings to maintain said riser at a selected height above the ground.

3. The height adjustable riser for a sprinkler defined in claim 2 wherein:

said openings are arranged in at least two levels separated from each other.

4. The height adjustable riser for a sprinkler defined in claim 3 wherein:

said openings are square shaped holes.

5. The height adjustable riser for a sprinkler defined in claim 3 wherein:

said openings are a continuous groove with a set of teeth in each groove; and said catch rideable with each groove and with a tooth engageable with said set of teeth to retain said cartridge and riser in a fixed position on said housing.

6. The height adjustable riser for a sprinkler defined in claim 5 including:

a flexible and expandable hose carried on said cartridge for discharging water against said impact plate of said tube.

7. The height adjustable riser for a sprinkler defined in claim 6 including:

an extension member disposed between said housing and said riser serving to heighten said nozzle in addition to said catches and grooves.

8. A height adjustable riser for a sprinkler comprising:

a cylindrical housing buried in the ground;

said riser movably supporting a sprinkler nozzle normally spring biased within said riser;

a height adjusting cartridge secured to said sprinkler nozzle and movable therewith as a unit; and adjusting means cooperatively disposed between said cartridge and said housing for selectively locating said sprinkler nozzle above the ground.

9. The height adjustable riser for a sprinkler defined in claim 8 wherein:

said adjusting means includes catch means spring biased outwardly to bear against said housing and a plurality of openings in said housing selectively engageable by said catch means to releasably secure said sprinkler nozzle in a selected height position.

10. A height adjustable riser for a sprinkler comprising:

a cylindrical housing buried in the ground;

said riser movably supporting a sprinkler nozzle normally spring biased within said riser;

a height adjusting cartridge secured to said sprinkler nozzle and movable therewith as a unit;

an open-ended conduit provided in said cartridge terminating adjacent said sprinkler nozzle;

a pressurized water supply coupled to said conduit introducing pressurized water to said sprinkler nozzle for forcibly urging said sprinkler nozzle to move in said riser; and adjusting means cooperatively disposed between said cartridge and said housing for selectively locating said sprinkler nozzle above the ground.

11. The height adjustable riser for a sprinkler defined in claim 10 including:

an extension member disposed between said housing and said riser serving to heighten said nozzle in addition to said catches and grooves.

12. The height adjustable riser for a sprinkler defined in claim 11 including:

a flexible and expandable hose carried on said cartridge for conducting pressurized water into said conduit for impacting against said sprinkler nozzle.

* * * * *